United States Patent [19]

Talbert

[11] 4,150,449

[45] Apr. 24, 1979

[54] METHOD AND APPARATUS FOR WASHING TEXTILE FABRIC

[75] Inventor: James E. Talbert, Lancaster, S.C.

[73] Assignee: Morrison Textile Machinery Co., Fort Lawn, S.C.

[21] Appl. No.: 900,249

[22] Filed: Apr. 26, 1978

[51] Int. Cl.[2] ..... D06B 3/12

[52] U.S. Cl. ..... 8/151; 68/22 R; 68/27; 68/62; 68/181 R

[58] Field of Search ..... 8/151; 68/22 R, 27, 68/62, 181 R

[56] References Cited

U.S. PATENT DOCUMENTS

| | | | |
|---|---|---|---|
| 3,145,554 | 8/1964 | Grimes | 68/27 X |
| 4,056,954 | 11/1977 | Meier-Windhorst | 68/181 R X |

FOREIGN PATENT DOCUMENTS

| | | | |
|---|---|---|---|
| 2521600 | 11/1976 | Fed. Rep. of Germany | 68/181 R |
| 2630786 | 1/1977 | Fed. Rep. of Germany | 68/181 R |

*Primary Examiner*—Philip R. Coe

*Attorney, Agent, or Firm*—Bell, Seltzer, Park & Gibson

[57] ABSTRACT

A method and apparatus for washing running length textile fabric in open width, in which fabric advances generally upwardly through a washing chamber and along a sinuous path having a plurality of substantially planar runs inclined at an angle to the horizontal while wash water cascades downwardly on the fabric. The wash water cascades from one to another of a plurality of trays in such a manner as to bring fabric being washed into contact with progressively cleaner water as the fabric is being progressively cleaned.

16 Claims, 5 Drawing Figures

METHOD AND APPARATUS FOR WASHING TEXTILE FABRIC

It has been known in textile finishing operations to subject textile fabrics to liquid treatment including washing in open width running lengths. Early forms of methods and apparatus for washing textile fabrics in open width provided for dipping of vertical runs of fabric into wash water, and typically required substantial quantities of water to clean the fabrics being processed. For example, the weight of water required by such methods and apparatus to clean a given weight of fabric has been on the order of three or more times the weight of the fabric.

Efforts to improve the efficiency of such methods and apparatus have included the development of countercurrent arrangements in which fabric guided along a sinuous path moves generally upwardly through a washing chamber while liquid flows generally downwardly, countercurrent to the fabric movement. While such methods and apparatus have improved washing efficiency to such a point that the weight of water required is on the order of two times the weight of fabric processed, it has been observed that liquid flow within such apparatus is uncontrolled leading to uneven subjection of fabric in various runs within the chamber to the flowing liquid and, in some apparatus, to undesirable distortion and stretching of fabric due to loading with liquid.

With the above prior developments and difficulties in mind, it is an object of the present invention to wash textile fabric in accordance with a method and through the use of an apparatus in which contact between fabric and liquid is controlled in such a manner as to maximize washing efficiency. In realizing this object of the present invention, fabric is brought into contact with decreasing quantities of progressively cleaner water as the fabric is progressively cleaned. This is accomplished by cascading water downwardly onto the fabric and from one to another of a plurality of vertically stacked cascade trays of progressively greater capacity having respective spill lip portions underlying corresponding portions of fabric runs with each spill lip portion also underlying such lip portion of any cascade tray thereabove and overlying such lip portion of any cascade tray therebelow.

Another object of this invention is to facilitate maintenance of a running length of fabric being washed in open width condition. In realizing this object of the present invention, stretching and bellying of the fabric due to the weight of cascading water is avoided by guiding fabric along a sinuous path having a plurality of substantially planar runs inclined at an angle to the horizontal. The inclination of the runs is such as to facilitate run-off of cascaded wash water, as distinguished from the accumulation of water in bellies or pockets otherwise formed in and distorting fabric moving in the runs.

BRIEF DESCRIPTION OF THE DRAWINGS

Objects and advantages of the invention having been stated, other objects and advantages will appear as the description proceeds when taken in connection with the accompanying drawings, in which.

DETAILED DESCRIPTION

Referring more specifically to the drawings, an embodiment of the apparatus of this invention is there shown as being especially constructed for carrying out the novel method of this invention in which textile fabric F is advanced generally upwardly through a washing zone within a chamber while being guided along a sinuous path having a plurality of planar runs inclined at an angle to the horizontal and, at the same time, wash water is cascaded downwardly onto the fabric and from one to another of a vertically stacked array of a plurality of trays, each having a spill lip portion underlying the spill lip portion of any next adjacent higher tray and overlying the spill lip portion of any next adjacent lower tray so that the fabric being washed contacts decreasing quantities of progressively cleaner water as the fabric is being progressively cleaned.

Figure 1:
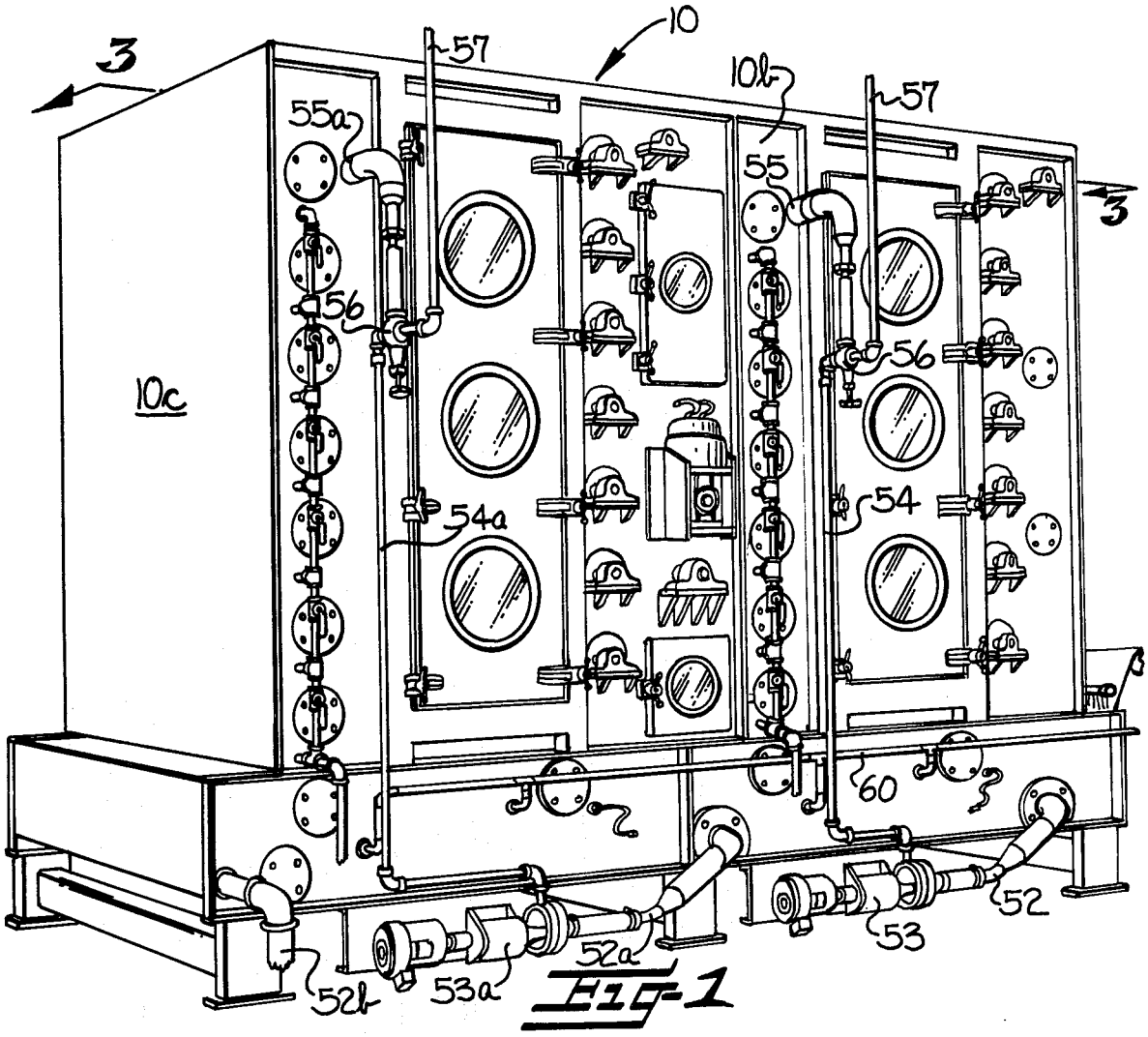
FIG. 1 is a perspective view of a preferred embodiment of apparatus for washing textile fabric in open width in accordance with this invention.
Figure 3:
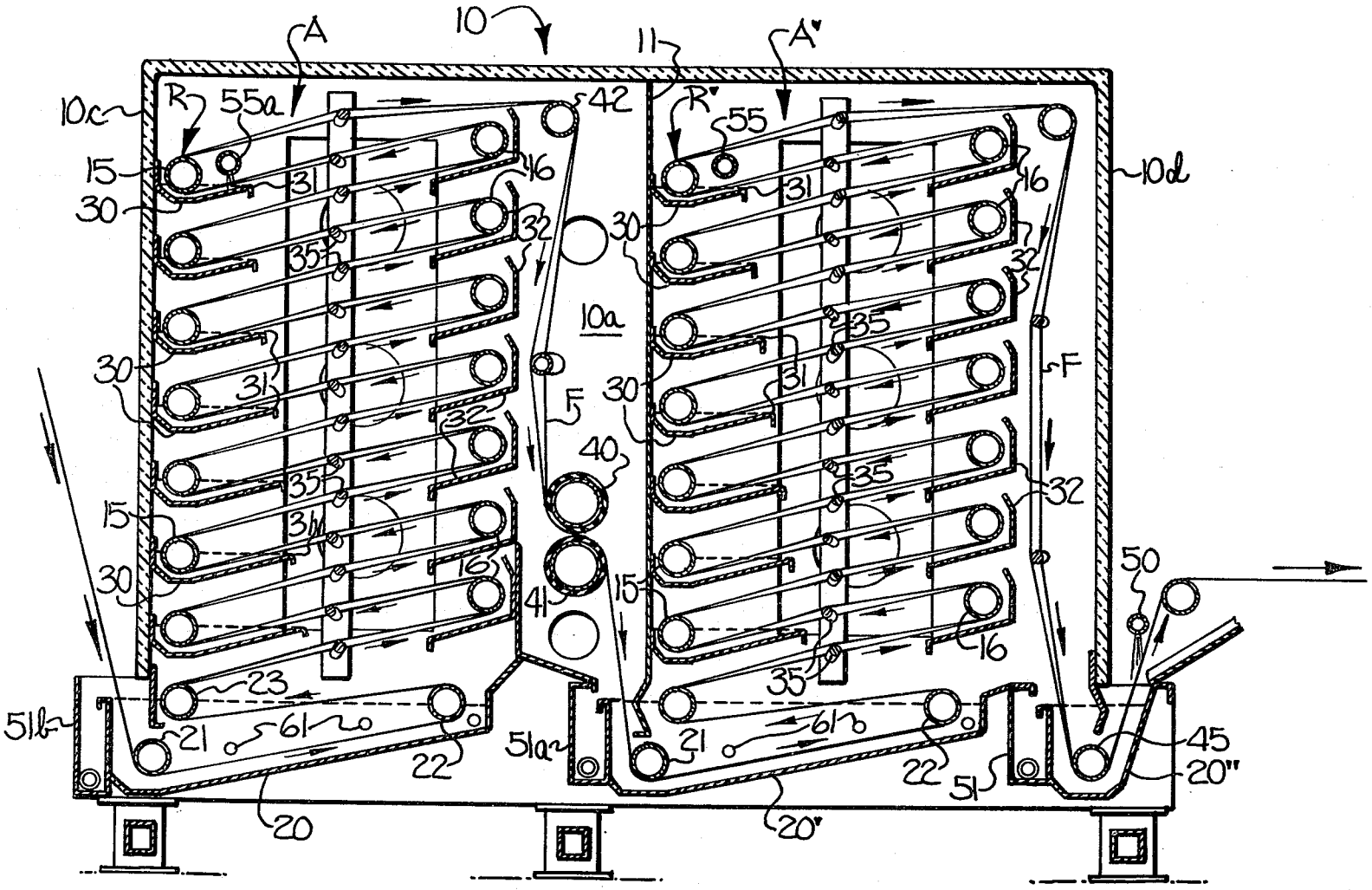
FIG. 3 is a schematic vertical sectional view taken substantially along line 3—3 in FIG. 1 and showing a preferred arrangement of rolls and cascade trays in the apparatus of this invention for carrying out the fabric washing method of the invention.
Figure 4:
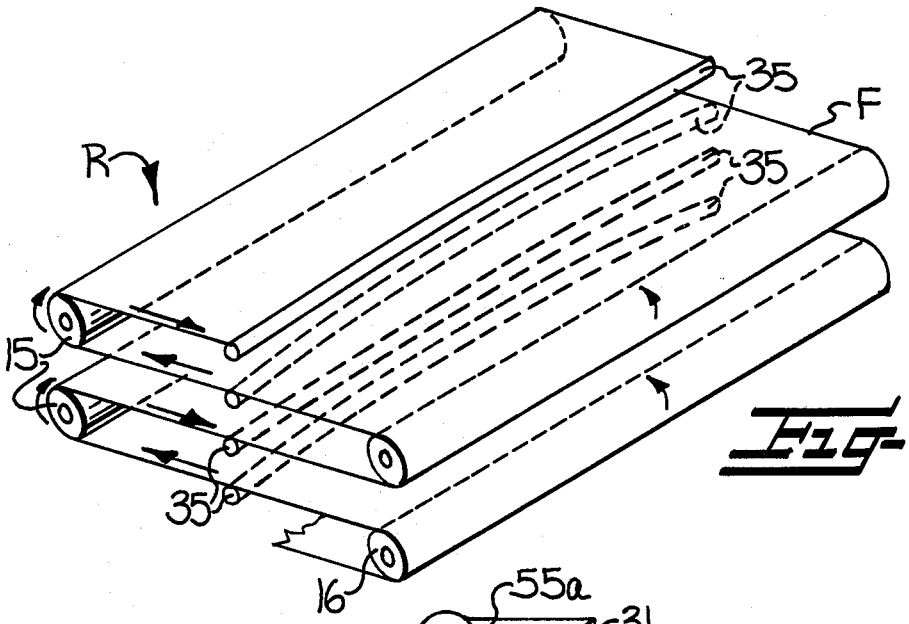
FIG. 4 is a fragmentary perspective view particularly illustrating an arrangement of stripper bars or wiper bars for stripping washing liquid from runs of the fabric between the adjacent fabric supporting rolls.
Figure 5:
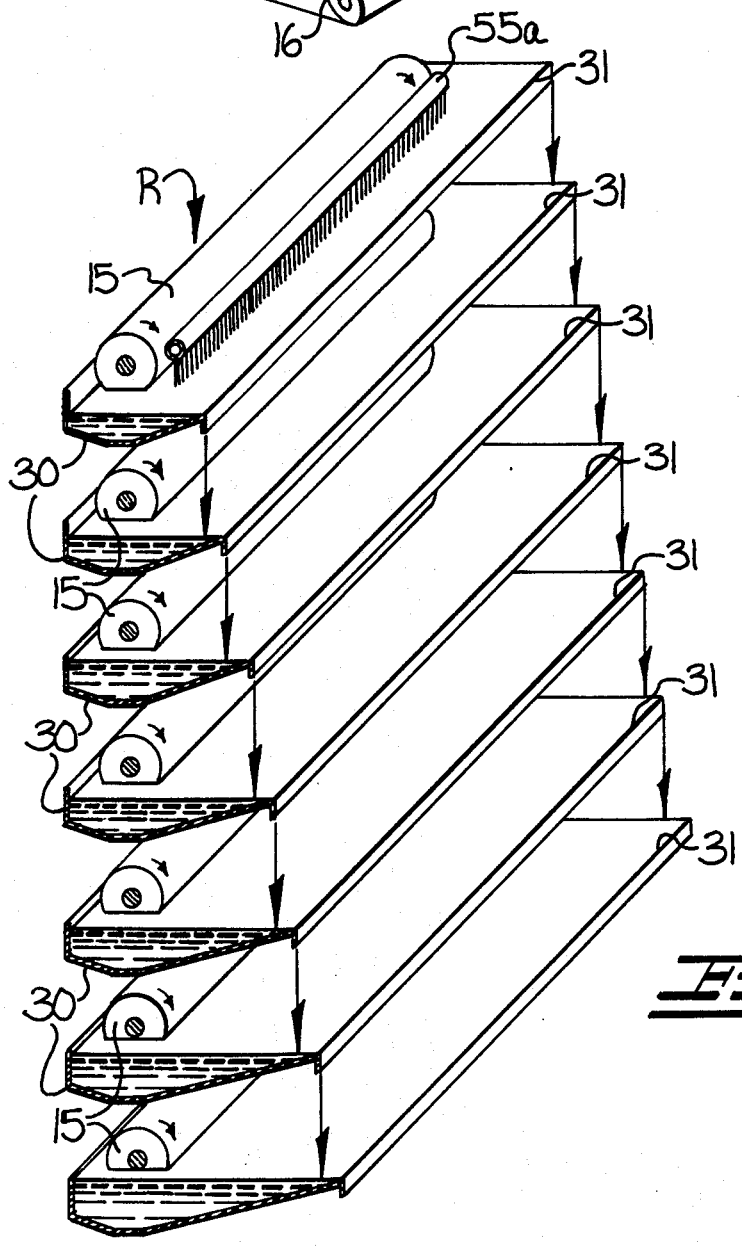
FIG. 5 is a perspective view of the cascade tray means such as are shown in the left-hand and central portions of FIG. 3, and particularly illustrating an offset relationship of the spill lip portions of a vertically stacked array of the trays such that the wash water cascades from each respective tray toward an underlying lip portion of any next adjacent lower tray as the fabric passes generally upwardly in the corresponding washing chamber and so that the fabric being washed contacts progressively cleaner water as the fabric is progressively cleaned.

Accordingly, as best shown in FIGS. 1 and 3, the apparatus comprises housing means 10 of generally rectangular form and provided with a lateral, substantially vertically disposed partition 11 therein extending across a medial portion thereof such that the housing means 10 defines rear and front, first and second washing zones in the form of chambers A, A′ successively arranged therein. Although two washing chambers are shown, only a single washing chamber may be provided in the apparatus, if desired.

Fabric supporting and guiding roll means are suitably journaled on opposite side walls **10*a*, 10*b* of the housing means 10 and positioned within each washing chamber A, A′, such roll means of each chamber A, A′ being shown in the form of a vertical row or set of vertically spaced, substantially horizontal rear or immersion guide rolls 15 and a vertical row or set of vertically spaced substantially horizontal front or auxiliary guide rolls 16. The front guide rolls 16 are spaced a substantial distance horizontally from the rear or immersion guide rolls 15 so as to provide a substantial length or run of open width fabric F passing between each respective pair of guide rolls 15, 16. Preferably, all the guide rolls 15, 16 within each chamber A, A′ are of substantially the same diameter, and the rear rolls 15 are spaced substantially the same distance apart as the front rolls 16 in the respective chamber, with the front rolls 16 being staggered vertically with respect to the rear rolls 15 so that the fabric F passing therebetween will extend along a sinuous or zig-zag path having substantially planar or straight, generally parallel runs inclined at a common predetermined shallow angle to the horizontal, such angle preferably being on the order of about 10 to 15 degrees. Such angle of movement of the fabric in each run prevents the wash water from puddling or otherwise accumulating on the fabric runs without advancing with the fabric. Very favorable results have been achieved by so positioning the rolls 15, 16** that the generally parallel runs of the fabric extending therebetween are inclined at a common angle of about 14° to the horizontal.

For purposes of this description, those guide rolls 15, 16 for guiding the fabric in open width form upwardly in a sinuous path within the first washing chamber A will be identified collectively herein as a "first roll assemblage" broadly designated at R, and those guide rolls 15, 16 for guiding the fabric upwardly in a sinuous path within the second washing chamber A' will be identified collectively herein as a "second roll assemblage" broadly designated at R'.

The fabric F to be washed enters the lower portion of the first chamber A through an ingress opening 17, provided below the rear wall 10*c* of housing means 10, and through which opening a rear portion of a first or rear sump or reservoir 20 extends. It will be noted that similar openings or passageways are provided beneath the lower edges of partition 11 and housing front wall 10*d* through which the rear portions of respective second and third sumps or reservoirs 20', 20'' extend. The first and second reservoirs 20, 20' are constructed to extend forwardly into the respective washing chambers A, A' and to underlie the runs of the fabric F extending between the guide rolls 15, 16 of the respective guide roll assemblages R, R'.

Each sump or reservoir 20, 20' is thus positioned in a lower region or zone located beneath a respective guide roll assemblage. Each first and second reservoir 20, 20' has suitable fabric guide means, which may take the form of a group of lower zone fabric guide rolls 21, 22, 23, rotatably mounted therein, for guiding the fabric F in open width through the wash water in the reservoirs 20, 20' and then generally upwardly to the respective guide roll assemblages R, R' in the respective washing chambers A, A'. Each of the rolls 21 serves as a fabric ingress roll with respect to the corresponding chamber A, A' and is shown entirely submerged in the wash water in the respective reservoir. The other lower zone fabric guide rolls 22, 23 also may be entirely submerged in the wash water in the reservoirs 20, 20' if desired. However, it may be desirable that the rolls 22, 23 are only partially submerged in the wash water as shown in FIG. 3. In any event, it is preferred that each roll 23, which serves as an egress roll with respect to the corresponding reservoir, is so positioned that the fabric F passes therefrom, in the direction indicated by the arrows in FIG. 3, and to the first and lowermost of the respective auxiliary guide rolls 16 thereabove along a path inclined at substantially the same angle as that at which the runs of the fabric F extend in their course between the rolls 15, 16 throughout the generally upward movement of the fabric in the respective washing chamber.

To enhance the washing of the textile fabric in open width, in accordance with the invention, means are provided for subjecting the fabric to progressively cleaner wash water as the fabric is progressively cleaned in the course of its generally upward travel through each washing chamber A, A'. To this end, cascade tray means are mounted in housing means 10 for cooperating with the roll means of each assemblage R, R' within each respective chamber A, A' in subjecting the fabric entrained about the roll means to wash water. Such tray means includes a vertically stacked array of a plurality of cascade trays 30 which, in this instance, extend beneath the respective immersion guide rolls 15 in each chamber A, A'. In order to provide the cascading effect of the wash water, the cascade trays have respective spill lip portions 31 which underlie adjacent portions of the respective lower runs of the fabric passing beneath the respective rolls 15. It will be noted that the spill lip portions 31 respectively underlie those lower lip portions of any next adjacent higher cascade trays 30 and they also overlie the lip portions 31 of any next adjacent lower trays.

Water circulating means, to be later described, is provided for delivering wash water into the uppermost of the cascade trays 30 in each respective chamber A, A', it being noted that each cascade tray 30 is so shaped as to not only underlie each respective immersion roll 15, but to also retain a quantity of wash water therein so that the corresponding portions of the fabric passing beneath the rolls 15 are immersed in the wash water in each respective cascade tray 30. From the foregoing description of the spill lip portions 31 on the cascade trays 30 in each washing chamber A, A', it can be appreciated that corresponding inwardly facing free edges defined by the spill lip portions 31 of the cascade trays in each array are offset inwardly with respect to any cascade tray thereabove and toward the vertical center of the respective guide roll assemblage R, R'. Thus, it can be appreciated that the wash water introduced into the uppermost of the trays 30 in each array will cascade downwardly from tray to tray within the respective washing chamber whereby the fabric F being washed contacts progressively cleaner water as the fabric is progressively cleaned. Since the cascade trays 15 of each vertical array of trays are shown of progressively increasing width from the top to the bottom of each array, this effects a correspondingly progressively increasing depth or water capacity to the cascade trays, as is desirable. The progressively increasing depth of the trays 15 in each array is counter to the generally upward movement of the textile fabric in each washing chamber so that, advantageously, successive portions of the fabric are immersed in the wash water for longer intervals in the earlier stages of the washing treatment (when the fabric is likely to be the dirtiest) than they are in subsequent stages of the washing treatment during the travel of the fabric in the region defined by each respective guide roll assemblage R, R'.

To aid in directing the wash water squeezed from the fabric passing beneath and about the auxiliary rolls 16 of the fabric guide roll assemblages R, R' into the respective reservoirs 20, 20' therebeneath, it is preferred that a shield tray or spill tray 32 is provided underlying each of the rolls 16 and adjacent portions of the fabric F in each chamber A, A'. Since the free edges of all the shield trays 32 face inwardly and extend over the respective fabric runs therebeneath, it can be seen that the shield trays 32 divert the water from the respective rolls 16 thereabove to the fabric runs. If desired, the shield trays 32 may be arranged similarly to the cascade trays 30 so that a cascading wash water effect also may be obtained at the corresponding side of the washing chamber.

To further aid in the washing operation, the lower surface of each inclined run of the fabric F in each chamber A, A', at a point about halfway between the adjacent immersion and auxiliary guide rolls 15, 16, is engaged throughout its width by an upwardly bowed stripper bar or wiper bar 35. Preferably, each stripper bar 35 not only is bowed upwardly, but it is also bowed in the direction toward which the respective run of the fabric F is moving during the washing operation. In other words, alternate stripper bars in each of the washing chambers A, A' are curved or bowed upwardly and to the right in FIG. 3 in accordance with the direction in which the respective alternate runs of the fabric F are moving in the region of each guide roll assemblage R, R'. Conversely, intervening stripper bars 35 between the alternate stripper bars in each of the washing chambers A, A' are curved or bowed upwardly and to the left in FIG. 3 also in accordance with the direction in which the respective intervening runs of the fabric F are moving during the washing operation.

It has been determined that such an arrangement of the stripper bars 35 tends to laterally stretch or tighten the taut fabric passing thereover and engaging the bars. Furthermore, it has been determined that each stripper bar 35 tends to pull the wash water downwardly through the fabric engaging the same thereabove and directs such water downwardly toward the run of the fabric therebeneath, the latter run always traveling in the opposite direction from the run of the fabric immediately thereabove as indicated by the arrows in FIG. 3. Thus, the wash water is caused to flow counter to the direction of travel of the respective run of the fabric beneath each respective stripper bar 35, all of which contributes to the effective cleaning of the fabric. Although, as heretofore indicated, it is preferred that the stripper bars 35 are bowed in the direction of travel of the respective runs of the fabric thereover, it has been determined that favorable results are also obtained utilizing stripper bars which are bowed upwardly in a vertical direction only.

Figure 2:
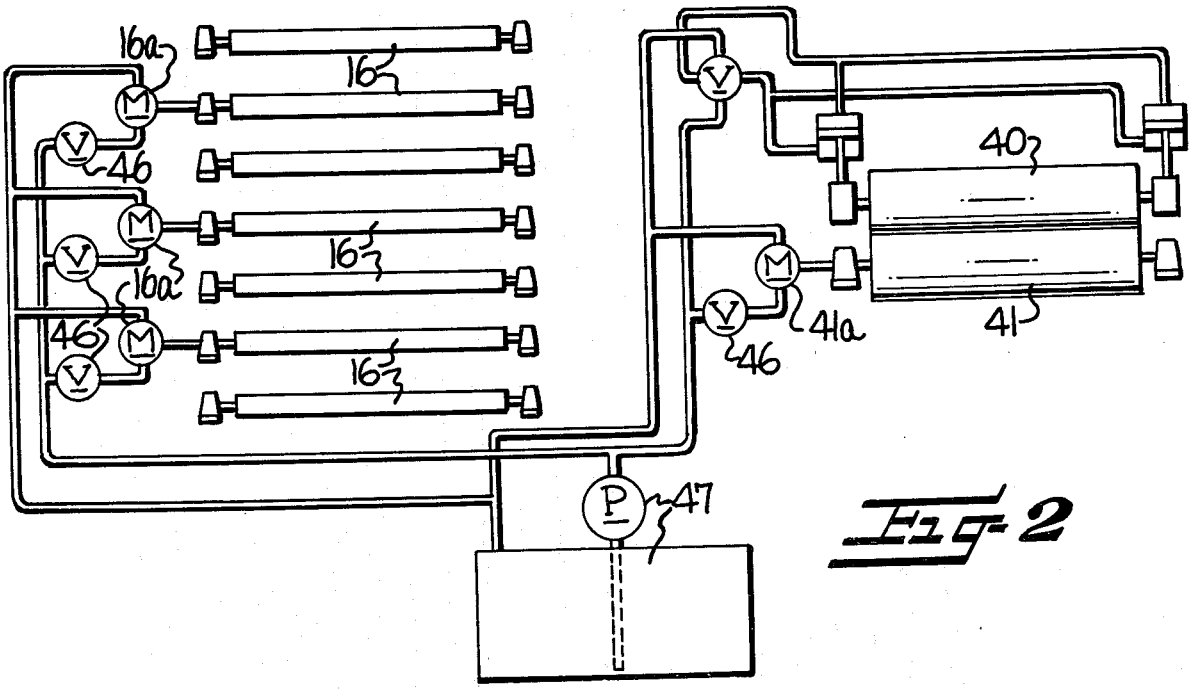
FIG. 2 is a schematic illustration of certain of the fabric supporting guide rolls of the apparatus showing how some of them may be driven.

Since the particular embodiment of the apparatus of this invention is shown in FIG. 3 as being provided with two washing chambers A, A' arranged in tandem, it is preferred that the forward portion of the rear washing chamber A is provided with suitable squeeze roll means through which the fabric is directed for squeezing water from the fabric after it has passed through the uppermost of the cascade trays 30 in the washing chamber A. As shown in FIGS. 2 and 3, such squeeze roll means may take the form of a pair of upper and lower squeeze rolls 40, 41 suitably rotatably supported by opposing side walls of the housing means 10. Since the construction of squeeze roll means is well-known in the art, a further more detailed description thereof is deemed unnecessary.

It can be seen that the fabric F passes forwardly over the uppermost of the auxiliary guide rolls 16 in the washing chamber A. Then the fabric passes over a suitable guiding roller 42, downwardly through the nip of the squeeze rolls 40, 41, and then downwardly into the second reservoir 20', where the fabric is guided in engagement with the lower zone guide rolls 21, 22, 23 therein and subsequently guided in the generally upward sinuous path by the immersion and auxiliary guide rolls 15, 16 of the guide roll assemblage R' in the second or front washing chamber A'. Thereafter, the fabric is suitably guided downwardly from the upper front portion of the front washing chamber A' so that it will pass beneath and in engagement with a fabric-egress guide roll 45 extending substantially horizontally within the third wash water reservoir 20''.

The reservoir 20'', other than being shown as having relatively lesser capacity than the reservoirs 20, 20' may be of substantially the same construction as the reservoirs 20, 20'. It will be noted that the fabric-egress roll 45 is immersed in the wash water within reservoir 20'' and is positioned in the opening defined beneath the lower edge of the front wall **10*b* of housing means 10. Thus, the fabric F passes through the latter opening and upwardly out of the reservoir 20'' and exteriorly of the housing means 10** for being advanced to a further processing operation such as a suitable drying apparatus, not shown.

In order to move and thereby advance the fabric being washed through the chambers A, A', the squeeze rolls 40, 41 and/or any other rolls about which the fabric is entrained may be driven by any suitable drive means, as may be desired. Also, the fabric may be advanced through the second or front chamber A' and forwardly away from the third reservoir 20'' by any suitable means such as driven squeeze rolls, not shown, or by any subsequent processing apparatus. By way of example, it will be observed in FIG. 2 that three of the seven auxiliary rolls 16 there shown are driven by respective motive means **16*a*, and the squeeze rolls 40, 41 are driven by a motive means 41*a*. The motive means 16*a*, 41*a* may take the form of fluid operated or hydraulic motors whose effective speeds may be controlled by respective valves 46 interposed in fluid connections between the motive means 16*a*, 41*a* and a source 47 of fluid under pressure. Although the second or front washing chamber A' is not shown having therein a set of squeeze rolls similar to those squeeze rolls 40, 41 in the first or rear chamber A, certain of the auxiliary rolls 16 in chamber A' and the egress roll 45 in reservoir 20'' may be driven by means such as that described for the rolls 16, 40, 41 with reference to FIG. 2. Accordingly, a further description and illustration of the means for advancing the fabric through the housing means 10** is deemed unnecessary.

It has been determined that an arrangement of the various rolls in each washing chamber A, A' such as to guide the fabric to pass generally upwardly along a sinuous path having generally parallel inclined runs, coupled with an arrangement of the cascade trays such as that described herein, contribute substantially to the conservation of wash water in that successive portions of the fabric will be cleaned effectively even though repeatedly subjected to wash water from a common source. Accordingly, the same water circulating means preferably is arranged to deliver wash water into the uppermost of the cascade trays 30 of both the washing chambers A, A'. To this end, it will be observed in the right-hand portion of FIG. 3 that a suitable wash water feed pipe 50 is so positioned as to direct wash water from a suitable source, not shown, into the open topped reservoir 20', it thus being apparent that the frontmost or egress reservoir 20'' contains the cleanest wash water in the entire housing means 10.

The water from reservoir 20'' overflows a weir defined by the rear upper edge of the rear wall of the egress reservoir 20'' and then flows into a trough 51 from which the wash water is withdrawn through a conduit or pipe means 52 (FIG. 1) by a suitably driven pump means 53 communicating therewith. The pump means 53 pumps the water being received therein from pipe means 52 upwardly through a pipe line 54 which extends upwardly and whose upper portion is communicatively connected to one end of a wash water distributing pipe or conduit 55 (FIG. 3) which may be closed at its free end and may be perforate or slitted along its length.

Pipe 55 extends alongside the uppermost immersion roll 15 in the second or front washing chamber A′ so that it overlies the uppermost cascade tray 30 in washing chamber A′. Thus it can be seen that the water overflowing from the reservoir 20″ is delivered into the uppermost cascade tray 30 in the second or front washing chamber A′ and such water subsequently cascades downwardly onto the adjacent fabric runs and from tray to tray within chamber A′ until it precipitates into the sump provided by the second reservoir 20′.

The rear portion of the second reservoir 20′ also is provided with a trough **51*a* into which the wash water overflowing the second reservoir 20′ flows. The wash water received in the trough 51*a*, like the wash water received in the trough 51, is pumped outwardly therefrom through a pipe means 52*a* (FIG. 1) by suitable pump means 53*a* which pumps the wash water upwardly through a pipe line 54*a* having one end of a distributing pipe or conduit 55*a* connected thereto. The distributing pipe 55*a* is arranged above the uppermost of the cascade trays 15 in the first washing chamber A in substantially the same manner as that decribed with respect to the wash water distributing pipe 55** within the upper portion of the second washing chamber A′.

Thus, it can be appreciated that the water flowing from the distributing pipe **55*a* cascades downwardly from tray to tray of the array of trays 15 within the first or rear washing chamber A to precipitate into the first reservoir 20 therebeneath. The dirtiest wash water, being that collected in the rear reservoir 20, is thus permitted to overflow the weir defined by the rear upper edge of the rear wall of the reservoir 20 and, thus, the dirty wash water falls into a trough 51*b* which is similar to the troughs 51, 51*a* and which has a suitable discharge pipe 52*b* communicatively connected thereto for discharging the waste water from the housing means 10**.

In the event that it is desired that the wash water be heated, it will be observed in FIG. 1 that each of the pipe lines 54, **54*a* extending upwardly from the respective pump means 53, 53*a* has a manually operable valve means 56 connected thereto for selectively admitting hot water or steam from a suitable source, not shown, via conduits 57, into the wash water being pumped through the respective pipe lines 54, 54*a*. Additionally, the wash water in each of the first and second reservoirs 20, 20′ may be heated by steam or hot water directed thereinto from the source, not shown, through pipe means 60 (FIG. 1) and respective perforated pipes 61 extending substantially horizontally within the reservoirs 20, 20′. Since the manner of heating wash water and controlling the temperature thereof is well known in the art, a further more detailed description thereof will not be given here. It is also apparent that suitable drain cocks or valve controlled drainage pipes may be provided for draining the wash water from the cascade trays 30 and reservoirs 20, 20′, 20″** when desired, such as for flushing any accumulated dirt out of the various trays and reservoirs. Since such drainage cocks and pipes do not constitute parts of the present invention a further description thereof is deemed unnecessary.

It is thus seen that there is provided an improved method and apparatus for washing textile fabric in open width in which the fabric is guided to pass generally upwardly through a washing chamber along a path having generally parallel runs inclined at a common angle to the horizontal and wherein wash water is cascaded downwardly within the washing chamber onto the fabric runs and from one to another of a vertically stacked array of a plurality of trays, each of which has a spill lip portion underlying such portion of any next adjacent higher tray and overlying such portion of any next adjacent lower tray, whereby the fabric being washed contacts progressively cleaner water as the fabric is progressively cleaned.

In the drawings and specification there has been set forth a preferred embodiment of the invention and although specific terms are employed, they are used in a generic and descriptive sense only and not for purposes of limitation.

That which is claimed is:

1. A method for washing textile fabric in open width comprising:

advancing fabric generally upwardly through a washing zone, while cascading wash water downwardly within the zone from one to another of a plurality of vertically stacked cascade trays having respective spill lip portions, while catching and maintaining in progressively lower trays increasingly larger quantities of wash water, and while guiding the upwardly advancing fabric through the wash water and along a sinuous path having a plurality of substantially planar runs inclined to the horizontal, whereby the greater the need for washing of an incremental length of fabric, the greater is the volume of water in which said incremental length is immersed as the fabric is being progressively cleaned during its upward travel through the zone.

2. A method according to claim 1 wherein the step of guiding the upwardly advancing fabric comprises entraining the fabric about rolls mounted within the zone for defining said runs as generally parallel portions of said sinuous path.

3. A method according to claim 1 wherein the step of guiding the upwardly advancing fabric comprises entraining the fabric about rolls mounted within the zone for defining said runs as inclined at a common angle to the horizontal.

4. A method according to claim 1 wherein the step of guiding the upwardly advancing fabric comprises entraining the fabric about rolls mounted within the zone for defining said runs, and engaging said fabric at points along said runs intermediate the rolls with stripper bars for maintaining the fabric in open width.

5. A method for washing textile fabric in open width comprising:

advancing fabric generally upwardly through a washing chamber, while cascading wash water downwardly within the chamber from one to another of a plurality of vertically stacked cascade trays having respective spill lip portions with each spill lip portion underlying such lip portion of any cascade tray thereabove and overlying such lip portion of any cascade tray therebelow, while catching and maintaining in progressively lower cascade trays increasingly larger quantities of wash water, and while entraining the fabric about a plurality of rolls mounted within the chamber of rotation about generally horizontal axes and guiding the upwardly advancing fabric through the wash water along a sinuous path having a plurality of generally parallel, substantially planar runs inclined at a common angle to the horizontal, whereby the greater the need for washing of an incremental length of fabric, the greater the volume of water in which said incremental length is immersed as the fabric is progressively cleaned during its upward travel through the chamber.

6. A method according to claim 5 further comprising stripping water from advancing fabric at points along said runs intermediate the rolls by engaging the fabric with stripper bars.

7. A method for washing textile fabric in open width comprising:

advancing fabric generally upwardly through a vertically extending first washing zone while guiding the upwardly advancing fabric along a sinuous path having a plurality of substantially planar runs inclined at an angle to the horizontal, then advancing fabric leaving the first zone generally upwardly through a vertically extending second washing zone while guiding the upwardly advancing fabric along a sinuous path having a plurality of substantially planar runs inclined at an angle to the horizontal, while supplying wash water to a point adjacent an upper run within the second zone and spilling wash water downwardly over the edges of spill lips within the second zone and progressively more closely approaching a vertical line as the water cascades from the top of the zone toward the bottom upon at least certain of the fabric runs and from one to another of a plurality of vertically stacked cascade trays and to a sump beneath the fabric runs, and while pumping wash water from the sump to a point adjacent an upper run within the first zone and spilling wash water downwardly over the edges of spill lips within the first zone and progressively more closely approaching a vertical line as the water cascades from the top of the zone toward the bottom upon at least certain of the fabric runs and from one to another of a plurality of vertically stacked cascade trays, whereby fabric being washed contacts progressively cleaner water as the fabric is being progressively cleaned during its travel successively through the first and second zones.

8. A method according to claim 7 further comprising squeezing water from the fabric at a point in its travel from the sinuous path in the first zone toward the sinuous path in the second zone.

9. Apparatus for washing textile fabric in open width comprising:

housing means for defining a washing zone, cascade tray means mounted in said housing means and including a vertically stacked array of a plurality of cascade trays each for catching wash water spilled from any next adjacent higher tray and having progressively greater capacities for maintaining in progressively lower trays increasingly larger quantities of wash water, means mounted in said housing means for advancing fabric generally upwardly through said zone and for guiding advancing fabric to be immersed in wash water in said trays and pass along a sinuous path having a plurality of substantially planar runs inclined at an angle to the horizontal, and means for delivering wash water into an upper tray in said array of trays to cascade downwardly from tray to tray and upon fabric in said runs within said zone, whereby the greater the need for washing of an incremental length of fabric, the greater is the volume of water in which said incremental length is immersed as the fabric is progressively cleaned during upward travel through said zone.

10. Apparatus according to claim 9 wherein said fabric advancing and guiding means comprises roll means mounted in said housing means for entrainment of fabric thereabout and for defining said runs as generally parallel portions of said sinuous path.

11. Apparatus according to claim 9 wherein said fabric advancing and guiding means comprises roll means mounted in said housing means for entrainment of fabric thereabout and for defining said runs as inclined at a common angle to the horizontal.

12. Apparatus according to claim 9 wherein said fabric advancing and guiding means comprises roll means mounted in said housing means for entrainment of fabric thereabout, and stripper bar means mounted in said housing means for engaging fabric intermediate said roll means and for maintaining engaged fabric in open width.

13. Apparatus for washing textile fabric in open width comprising:

housing means for defining a washing chamber, cascade tray means mounted in said housing means and including a vertically stacked array of a plurality of cascade trays each for catching wash water spilled from any next adjacent higher tray and having progressively greater capacities for maintaining in progressively lower trays increasingly larger quantities of wash water, roll means mounted in said housing means for entrainment of fabric thereabout and for advancing fabric generally upwardly through said chamber while guiding advancing fabric to be immersed in wash water in said trays and pass along a sinuous path having a plurality of substantially planar, generally parallel runs inclined at a common angle to the horizontal, and water circulating means for delivering wash water into an upper tray in said array of trays to cascade downwardly from tray to tray and upon fabric in said runs within said chamber, whereby the greater the need for washing of an incremental length of fabric, the greater the volume of water in which said incremental length is immersed as the fabric is progressively cleaned during upward travel through said chamber.

14. Apparatus according to claim 13 further comprising stripper bar means mounted within said housing means for engaging fabric advancing in said runs at points intermediate said roll means and for stripping wash water from engaged fabric.

15. Apparatus for washing textile fabric in open width comprising:

housing means for defining first and second washing zones, means mounted in said housing means for advancing fabric successively generally upwardly through said first zone and then generally upwardly through said second zone and for guiding advancing fabric to pass successively along a first sinuous path having a plurality of substantially planar runs inclined at an angle to the horizontal and extending within said first zone and then along a second sinuous path having a plurality of substantially planar runs inclined at an angle to the horizontal and extending within said second zone, cascade tray means mounted in said housing means and arranged for cooperating with said fabric advancing and guiding means in subjecting fabric to wash water, said tray means including first and second vertically stacked arrays of a plurality of cascade trays in respective ones of said first and second zones and each having a spill lip portion adapted to underlie a corresponding portion of a fabric run and positioned to underlie such spill lip portion of any next adjacent higher tray and overlie such spill lip portion of any next adjacent lower tray, said cascade trays in each of said arrays having progressively increasing widths from the top to the bottom of each array, and water circulating means for delivering wash water into an upper tray in said second array to cascade downwardly from tray to tray and upon fabric in said second sinuous path and for delivering such wash water from said second zone into an upper tray in said first array to cascade downwardly from tray to tray and upon fabric in said first sinuous path, whereby fabric being washed contacts progressively cleaner water as the fabric is progressively cleaned during upward travel through said chambers.

16. Apparatus according to claim 15 further comprising squeeze roll means mounted in said housing means for squeezing water from the fabric at a point in its travel from the first sinuous path to the second sinuous path.

* * * * *

UNITED STATES PATENT AND TRADEMARK OFFICE

CERTIFICATE OF CORRECTION

PATENT NO. : 4,150,449

DATED : April 24, 1979

INVENTOR(S) : James E. Talbert

It is certified that error appears in the above-identified patent and that said Letters Patent are hereby corrected as shown below:

Column 9, Line 7 after the word "chamber" delete of and insert therefor - for -

Signed and Sealed this

Ninth Day of October 1979

[SEAL]

*Attest:*

RUTH C. MASON
*Attesting Officer*

LUTRELLE F. PARKER
*Acting Commissioner of Patents and Trademarks*